United States Patent [19]

Manning

[11] 4,138,771

[45] Feb. 13, 1979

[54] SLIDE FASTENER HAVING A REINFORCED SEPARATING END STOP

[75] Inventor: Harry F. Manning, Meadville, Pa.

[73] Assignee: Textron Inc., Providence, R.I.

[21] Appl. No.: 779,005

[22] Filed: Mar. 18, 1977

[51] Int. Cl.[2] ..... A44B 19/24

[52] U.S. Cl. ..... 24/205.11 F

[58] Field of Search ..... 24/205.11 R, 205.11 F, 24/205.16 R

[56] References Cited

U.S. PATENT DOCUMENTS

| | | | |
|---|---|---|---|
| 3,377,668 | 4/1968 | Carlile et al. | 24/205.11 F |
| 3,490,970 | 1/1970 | Heimberger | 24/205.11 F |

FOREIGN PATENT DOCUMENTS

| | | | |
|---|---|---|---|
| 87313 | 2/1965 | France | 24/205.11 F |
| 1077986 | 8/1965 | United Kingdom | 24/205.11 F |

*Primary Examiner*—Kenneth J. Dorner

*Attorney, Agent, or Firm*—O'Brien and Marks

[57] ABSTRACT

A slide fastener is disclosed as being secured to garment edges which are to be detachably connected. The slide fastener includes a reinforced separating end stop attached to a pair of stringer tapes having interengaging elements operable by means of a slider. Reinforcing of the separating end stop is effected by tapered reinforcing means in grooves of a pre-corrugated section of a sized stringer tape disposed adjacent the end stop.

3 Claims, 14 Drawing Figures

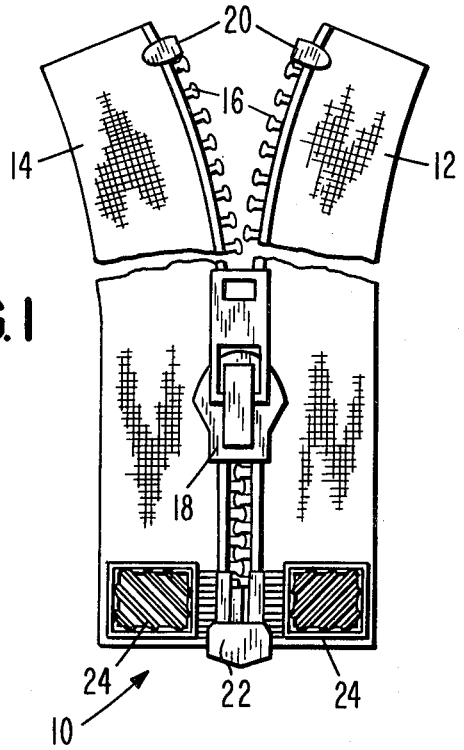
FIG. 1
FIG. 2
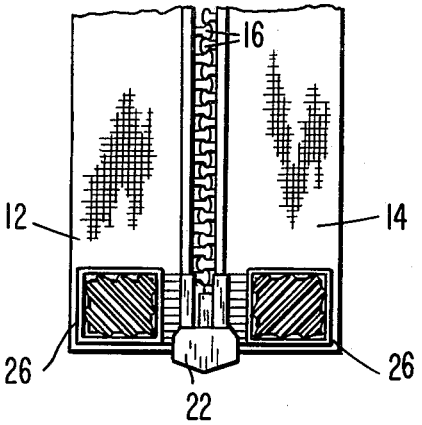
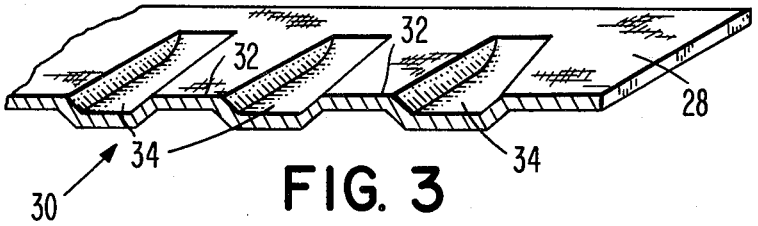
FIG. 3
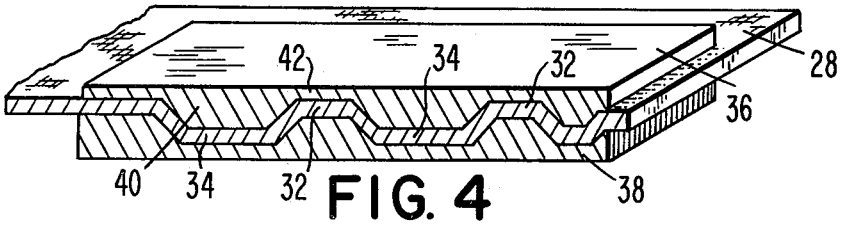
FIG. 4
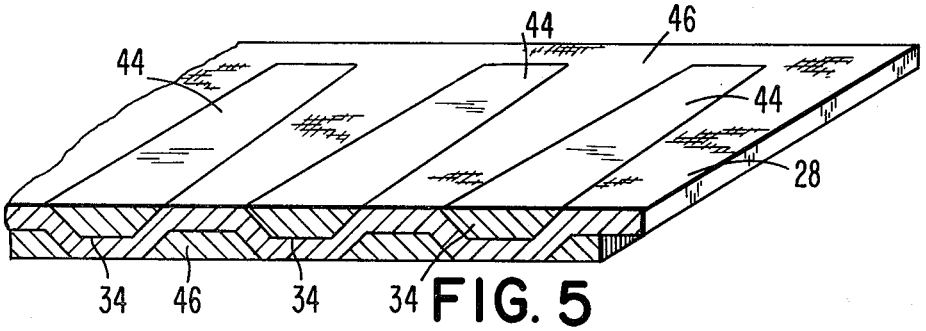
FIG. 5

FIG. 12
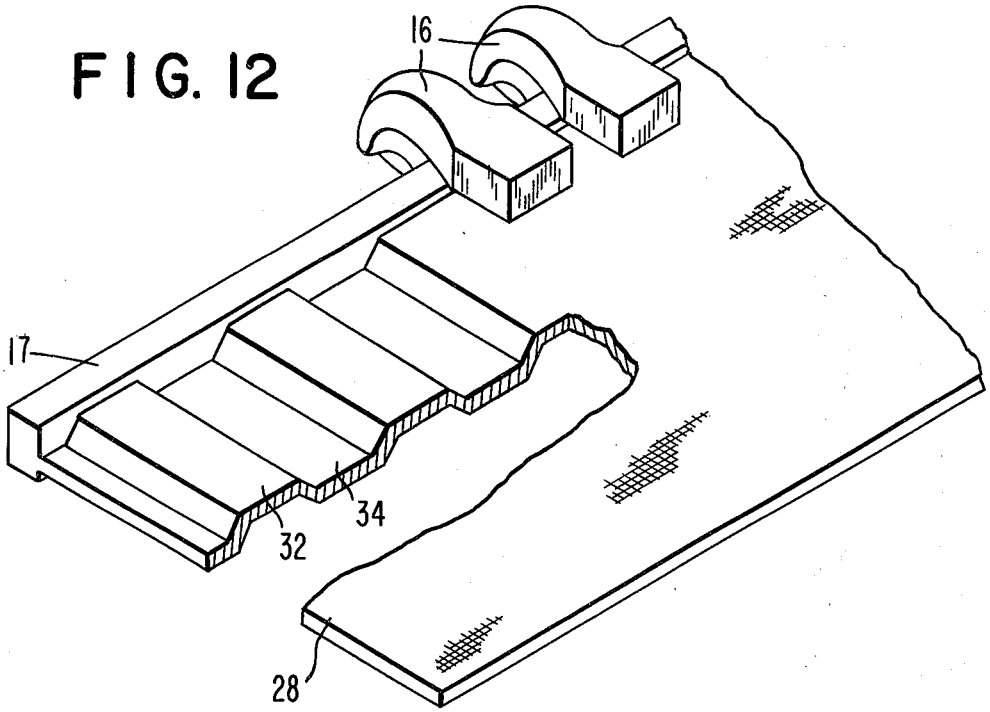
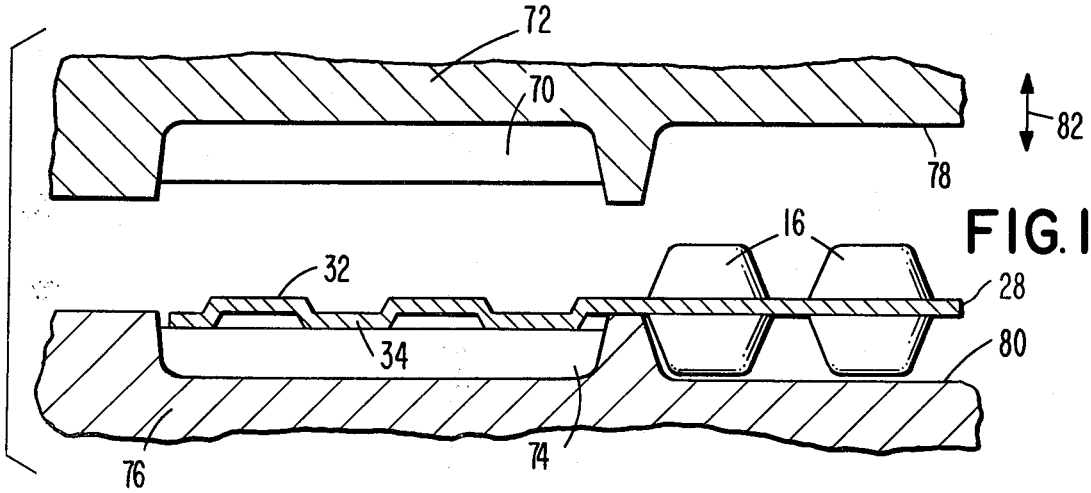
FIG. 13
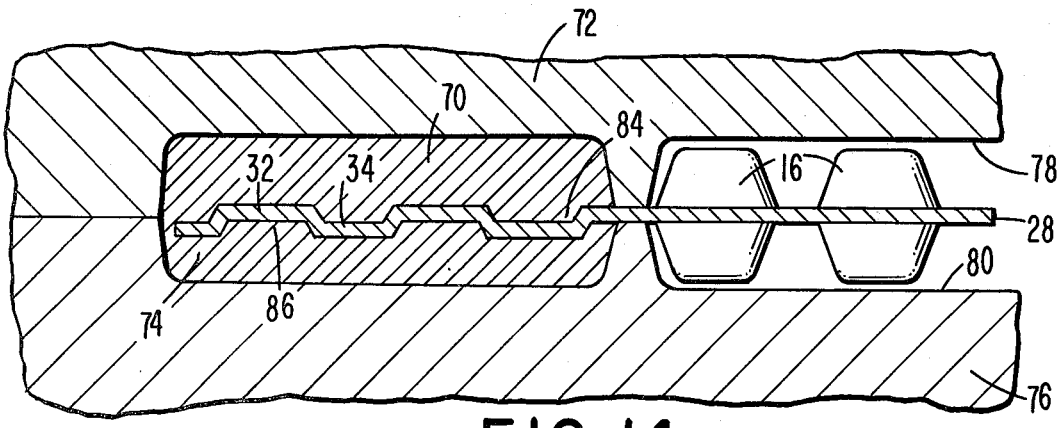
FIG. 14

SLIDE FASTENER HAVING A REINFORCED SEPARATING END STOP

BACKGROUND OF THE INVENTION

1. Field of the Invention

The present invention relates to slide fasteners, and more particularly to slide fasteners having a reinforced separating end stop.

2. Description of the Prior Art

Numerous slide fasteners are known to the art such as the type having a separating end stop attached to a pair of stringer tapes provided with opposed interengaging elements operable by means of a slider. When edges of an article are joined by a slide fastener, the tensional stresses are more or less uniformily distributed along the entire length of the stringer tapes because of the large number of closely positioned interengaging elements. However, when the slide fastener is joined only by means of the separating end stop or additionally by means of only a limited number of interengaging elements adjacent the separating end stop, great tensional stresses are caused to occur along the ends of the stringer tapes in the area of the separating end stop which over a limited period of use causes wear or fraying of the material forming the stringer tapes.

Attempts by the prior art to resolve the recognized problem of wear or fraying of the material forming the stringer tapes in the area adjacent the end stops have been limited because of recognized requirements that the slider be permitted to operate over the end stops for disengagement, as well as the need to perserve esthetic quality of the fastener.

Although the prior art has recognized the need to reinforce stringer tapes in the area of wear adjacent the end stop members of a slide fastener, the requirements of functionality and esthetic appeal have presented obstacles which have limited commercial acceptance of proposed solutions to this problem of wear.

Accordingly, although great improvements have been made in the simplicity, effectiveness, and limited breakage of the slide and interengaging elements forming a slide fastener, the useful life thereof remains limited because of damage by tensional stresses in the area of the end stop portion of the stringer tapes.

One attempt to reinforce a slide fastener in the area of the end stop is that disclosed in U.S. Pat. No. 3,872,551. Here, the end stop components are secured to the stringer tapes by means of tape reinforcing flaps which are laminated over the surface of opposite sides of the tapes. The reinforcing flaps comprise a grid effect formed of a framed border having rib elements disposed therein. Although effective reinforcing of the stringer tapes ends may be accomplished by this device, the reinforcing flaps are merely joined by a laminated member of limited thickness over the surface of the stringer tapes to the end stop members such that tensional forces, although limited somewhat, remain in the plane of the material forming the stringer tapes adjacent the end stop.

Another attempt to reinforce a slide fastener in the area of the end stop is that disclosed in British Specification No. 1,077,986 wherein reinforcement is achieved by means of gap ribs extending laterally of the taps in a zig-zag configuration joining to a reinforcing grid. Because of the tendency of the material forming the stringer tapes to return to a horizontal plane, gaps tend to appear along the side walls of the gap ribs resulting in poor adhesion with the stringer tape. Thus, although the gap ribs of this British Specification provide a somewhat stronger union between the reinforcement grid and stop end elements by reason of increased thickness, wear caused by the thicker ribs rubbing against unsecured portions of the stringer tapes tending to return to a normal plane presents a serious defect to this attempted solution of the problem.

It has now been found that by practice of the present invention, there is provided a simple, effective and esthetic solution to the problem of wear by tensional forces in the immediate area of stringer tapes adjacent the end stop elements.

SUMMARY OF THE INVENTION

Generally stated, the slide fastener of the present invention includes first and second stringer tapes having interengaging elements disposed along the inner edges thereof, a slider movable over the interengaging elements for operation thereof, a separating end stop for limiting movement of the slider and permitting separation of the stringer tapes, and reinforcing elements disposed in grooves of a pre-corrugated section of sized stringer tapes and disposed adjacent to and joining the elements forming the end stop.

Accordingly, it is an object of the present invention to provide a slide fastener having means disposed adjacent the end stop which effectively reinforce the material forming the stringer tapes.

Another object of the present invention is to overcome aforementioned disadvantages of prior art attempts to limit wear and fraying of stringer tapes in the area adjacent the end stop of a slide fastener.

Yet another object of the present invention is to provide a means which effectively limit tensional stresses in material forming stringer tapes of a slide fastener while providing a stronger union for elements forming the end stop and permitting movement of the slider thereover.

Another object of this invention is to provide a reinforcement means disposed intermediate a reinforcing grid and elements forming the stop end.

A further object of the present invention is to provide a simple, highly efficient, operable and esthetic slide fastener having means for reinforcing stringer tapes in the area most subject to wear adjacent the stop ends.

Another object of the present invention is to provide a method for improved manufacture of slide fasteners having reinforcing elements disposed adjacent end stop members.

Advantages of the present invention over the prior art include more effective preparation of slide fasteners having reinforcement elements which limit tensional stresses, improve the strength of elements immediately adjacent the end stop members, while permitting effective operation of the slide and yet providing a product having commercial feasibility and esthetic acceptance.

Other objections and advantages of the present invention will become apparent from the following detailed description taken in conjunction with the accompanying drawings wherein similar elements are identified by like numerals throughout the several views.

BRIEF DESCRIPTION OF THE DRAWINGS

FIG. 1 is a broken front elevational view of a slide fastener including the reinforcing means of the present invention.

FIG. 2 is a rear view of the slide fastener of FIG. 1.

FIG. 3 is an enlarged perspective view taken in partial section and illustrating corrugations formed along an edge portion of a stringer tape.

FIG. 4 is an enlarged perspective view illustrating a laminate reinforcing member disposed in the corrugations of the stringer tape of FIG. 3.

FIG. 5 is an enlarged perspective view illustrating an embodiment reinforcing member disposed as lateral ribs in valley or groove portions of the corrugations of the stringer of FIG. 3.

FIG. 12 illustrates a partial perspective view of a sized and corrugated stringer tape prior to receiving the reinforcing member.

FIG. 13 diagrammatically illustrates in half-cross section an open mold useful for molding a refinforcement member onto the stringer tape of FIG. 12.

FIG. 14 diagrammatically illustrates in half-cross section the molding sequence when a thermoplastic member may be molded as a reinforcement member onto the stringer tape of FIG. 12.

DESCRIPTION OF THE PREFERRED EMBODIMENTS

Figure 6:
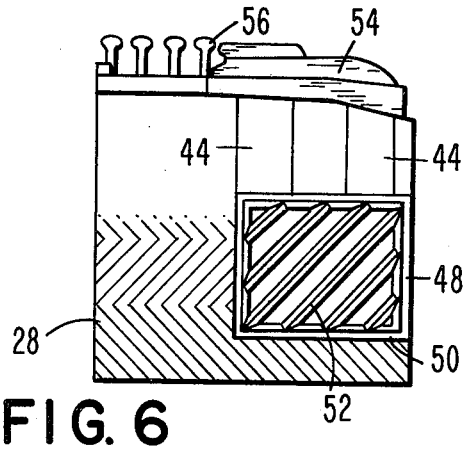
FIG. 6 is a partial top elevational view of the embodment reinforcing member of FIG. 5 including further a grid reinforcement member.

Referring to the drawings, FIG. 1 illustrates slide fastener 10 of the present invention having a pair of stringer tapes 12 and 14 with interengaging elements 16 disposed along inner edges thereof and defining a longitudinal center of the slide fastener. In use, the stringer tapes 12 and 14 are secured to edges of an article, not shown, which are to be opened and closed.

Slider 18 which is movable along the interengaging elements, operates to permit opening and closing of the slide fastener. Although only one slider is illustrated, it will be appreciated that a plurality of sliders may be used including opposed sliders movable along the interengaging elements such that opening and closing of the slide fastener elements may be effected from opposite ends.

Stop members 20 are secured to the inner edges of the stringer tapes near the terminal area of the interengaging elements and provide a means to limit movement of the slider beyond the interengaging elements.

Although generally illustrated, separating bottom stop 22 which may be any of a wide variety available to the art, is secured to an end of the interengaging elements opposite that of stop members 20. Separating bottom stop 22 is generally formed of mating elements secured to opposite stringer tapes. Thus, separating bottom stop 22 serves to limit downward movement of the slider while providing mating elements which may be disengaged to permit the stringer tapes to separate one from the other.

The elements forming the separating bottom stop 22 are each integrally formed with tape reinforcing flaps 24 which may be secured to opposite surfaces of each stringer tape 12 and 14, respectively, such as by ultrasonic welding or the like.

A number of bonding systems are available and may be used to secure the reinforcing flaps to the stringer tapes.

FIG. 2 illustrates a reverse side of the slide fastener of FIG. 1 with the opposite side of tape reinforcing flaps 26 being shown.

The stringer tapes may be formed of material such as cloth using natural or synthetic fibers. The material may be also suitably coated with a stiffening coating which provides a degree of rigidity to the stringer tapes.

A portion of stringer tape 28 is illustrated in FIG. 3 with corrugations 30 formed of alternating ridges 32 and grooves 34. The corrugations may be formed in the tape at the sizing operation, which operation serves to substantially reduce the thickness of the tape. The corrugations 30 are preformed in the tape prior to the application of the reinforcing elements which fill the grooves or valleys 34. One of the reinforcing elements of the present invention is that illustrated in FIG. 4. Although the reinforcing element is desirably formed of plastic material and especially a plastic material which may be heat molded into the preformed corrugations, it is appreciated that molded metallic reinforcing elements may be also used where the molded configuration mates within the grooves of the corrugations, as well as cast metal or stamped metal reinforcing elements.

One embodiment of the reinforcing element useful in practice of the present invention is that illustrated in FIG. 4 wherein preformed stringer tape 28 with ridges 32 and grooves 34 is reinforced on one surface with mating plate 36 and on the opposite surface with a similarily configurated mating plate 38. Plates 36 and 38 tend to sandwich the preformed corrugated section of the tape with projections or reinforcing ribs 40 being shaped to mate into grooves 34 with unitary surface sections 42 being disposed over the ridge areas of the corrugations. Except for being positioned in alternate grooves relative those of mating plate 36, oppositely disposed plate 38 has a similar configuration. Projection portions 40 have tapered cross sections as shown in FIG. 4 with the outer portions (adjacent the sections 42) wider than the inner portions (in the bottoms of the grooves 34). Tapered edges 43 of the projections on the top side of the tape 28 overlap tapered edges 45 of the projections on the bottom side of the tape 28.

An alternate embodiment of the reinforcing member of the present invention is that illustrated in FIG. 5 wherein stringer tape 28 has grooves 34 filled with reinforcing ribs 44. Ribs 44 may, if desired, be joined along the outer edges by a border strip. Ribs 46 on the bottom side of the corrugations are configurated similar to those of ribs 44 including, if desired, a border strip which joins the outer edges of the ribs for added strength. The ribs 44 and 46, similar to the projections 40 of FIG. 3, have tapered cross sections with overlapping tapered edges 43 and 45.

The projections 40, FIG. 4, and the ribs 44 and 46, FIG. 5, completely filling the grooves 34 as well as the overlapping tapered edges 43 and 45 maintain the positions of the reinforcing plates and ribs to preclude wear and abrasion on the tape.

FIG. 6 shows the embodiment reinforcing ribs 44 of FIG. 5 secured to stringer tape 28 and joined further to a reinforcing grid 48. Grid 48 is formed of a border 50 with intermediate rib members 52. The grid is laminated over the upper surface and a related grid is laminated over the bottom surface of the tape. In FIG. 6, the reinforcing section is illustrated secured to a female portion 54 of the separating end stop adjacent interengaging elements 56.

Figure 7:
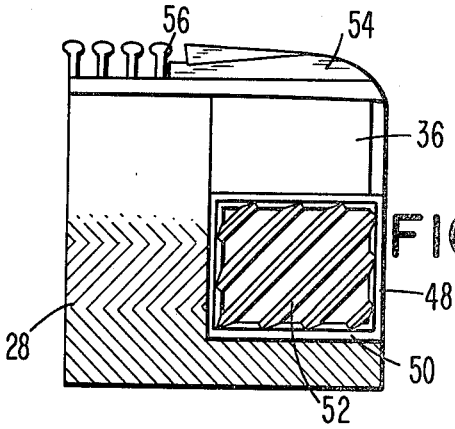
FIG. 7 is a partial top elevational view of the embodiment reinforcing member of FIG. 4 including further a grid reinforcement member.

FIG. 7 shows the embodiment reinforcing plate 36 of FIG. 4 secured to stringer tapes 28 and joined further to a reinforcing grid 48, also with border 50 and intermediate rib members 52, secured to a female portion 54 of the separating end stop.

Figure 8:
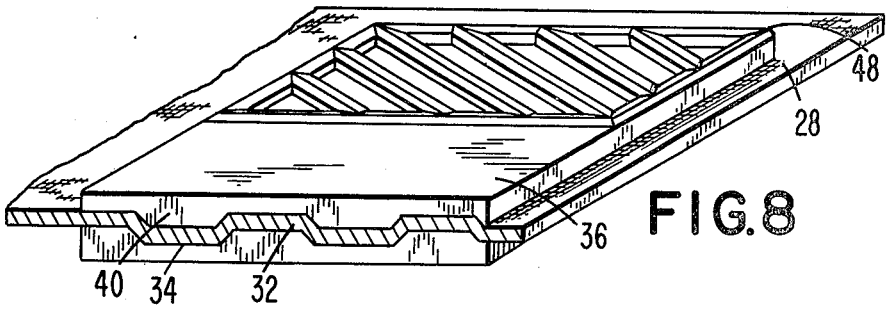
FIG. 8 illustrates a partial perspective view of the embodiment reinforcement member of FIG. 7.
Figure 9:
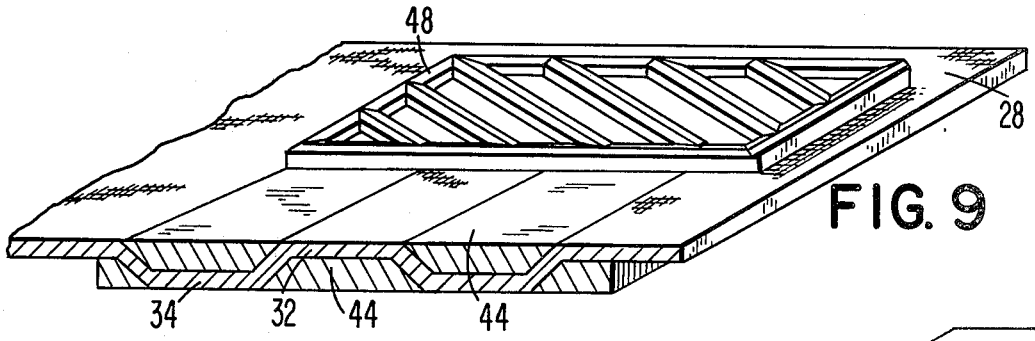
FIG. 9 illustrates a partial perspective view of the embodiment reinforcement member of FIG. 6.

FIGS. 8 and 9 illustrate in greater detail and in perspective view, the embodiments illustrated in FIGS. 7 and 6 respectively, except in partial section.

Figure 10:
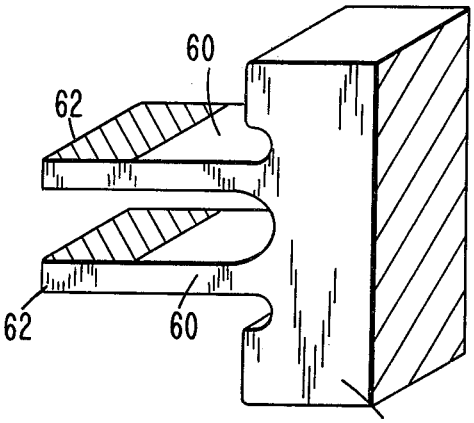
FIG. 10 illustrates in partial perspective view a reinforcement member prior to molding onto corrugated sections of a stringer tape.

FIG. 10 illustrates a reinforcing member as it may appear prior to being secured into preformed corrugations of the stringer tape. Base portion 58 is secured to either the male or female portion of the separating end stop with projecting flanges 60 joined further to grid reinforcing members 62. Flanges may be either preformed to mate within corrugations in the stringer tape, or may be press molded therein during the welding operation using heat and pressure.

Figure 11:
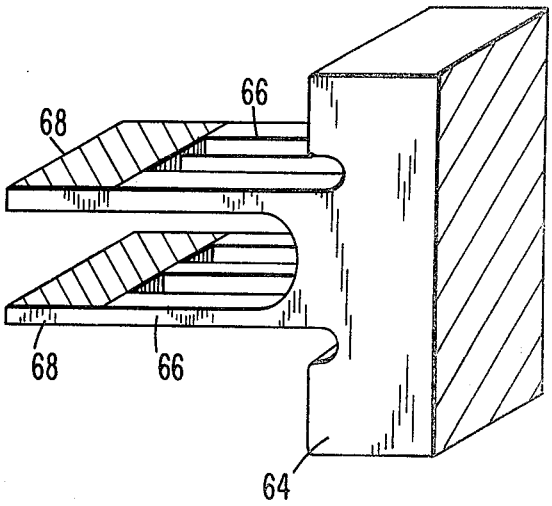
FIG. 11 illustrates in partial perspective view an embodiment reinforcement member prior to molding onto corrugated sections of a stringer tape.

FIG. 11 presents an alternate reinforcing member as it may appear prior to being secured into preformed corrugations of the stringer tape. Base portion 64 is secured to either the male or female portion of the separating end stop with projecting ribs 66 joined to grid reinforcing member 68. The rib members may be either preformed to mate within grooves of the corrugation or alternately may be press molded in the grooves during the welding operation.

In the method of the present invention, corrugations are preformed into a stringer tape in the area adjacent the separating end stop. Next, reinforcing elements are mold fitted into the preformed corrugations and bonded therein by a suitable means such as by ultrasonic welding.

FIG. 12 illustrates stringer 28 having interengaging elements 16, border 17 and corrugated ridges defined by ridges 32 and valleys 34.

FIG. 13 shows a pre-molding strip of a reinforcing member 70 within a cavity of upper mold 72 and reinforcing member 74 within a cavity of lower mold 76. The molds are provided with a receptive area 78 and 80 for receiving interengaging elements 16 without deformation. Stringer 28 is positioned within the upper mold which has relative movement in the direction of arrow 82 for the molding operation.

FIG. 14 shows molding of reinforcing member 70 within a cavity of upper mold 72 disposed in closed position onto lower mold 76 with portions of reinforcing member 70 being received as rib 84 into the valleys 34 whereas reinforcing member 74 is molded into ridges 32 as rib 86.

Inasmuch as the present invention is subject to numerous variations, modifications, and alternations in detail, it is intended that all the material in the foregoing specification or in the accompanying drawings should be interpreted in an illustrative, and not in a limiting sense.

What is claimed is:

1. A slide fastener comprising in combination:

first and second stringer tapes having interengaging elements disposed along inner edges thereof and defining a longitudinal center of the slide fastener;

a slider movable to effect engagement and disengagement of said interengaging elements;

separating end stop means on said stringer tapes adjacent one end thereof to limit movement of said slider, said separating end stop means including first and second mating means on said first and second stringer tapes, respectively;

each of said stringer tapes having a reinforcing grid on its end and spaced transversely outwardly from said longitudinal center;

each of said stringer tapes having a preformed corrugated portion on its end extending from its mating means to its reinforcing grid;

said corrugated portions defining alternating ridges and grooves on opposite sides of the tapes;

reinforcing means having portions with tapered cross sections filling each of said grooves whereby the grooves of said tapes are entirely covered; and said portions with tapered cross sections having outer portions wider than inner portions thereof so that the tapered edges of the reinforcing means on one side of the tape overlap the tapered edges of the reinforcing means on the other side of the tape to preclude wear and abrasion.

2. A slide fastener as recited in claim 1 wherein said reinforcing means comprises separate reinforcing ribs, one for each groove.

3. A slide fastener as recited in claim 1 wherein said reinforcing means comprises a plurality of reinforcing ribs, and wherein said ribs are integrally formed on unitary plate members, one for each side of the end of each tape whereby the grooves and ridges of said tapes are completely covered.

* * * * *